US007172680B2

(12) United States Patent
Turunen et al.

(10) Patent No.: US 7,172,680 B2
(45) Date of Patent: Feb. 6, 2007

(54) SHOE ROLL

(75) Inventors: Risto Turunen, Jyväskylä (FI); Stefan Kuni, Kotka (FI)

(73) Assignee: Metso Paper, Inc., Helsinki (FI)

( * ) Notice: Subject to any disclaimer, the term of this patent is extended or adjusted under 35 U.S.C. 154(b) by 492 days.

(21) Appl. No.: 10/472,291

(22) PCT Filed: Apr. 2, 2002

(86) PCT No.: PCT/FI02/00278

§ 371 (c)(1),
(2), (4) Date: Sep. 17, 2003

(87) PCT Pub. No.: WO02/079570

PCT Pub. Date: Oct. 10, 2002

(65) Prior Publication Data

US 2004/0079508 A1 Apr. 29, 2004

(30) Foreign Application Priority Data

Apr. 2, 2001 (FI) ..... 20010678

(51) Int. Cl.
*D21F 1/18* (2006.01)

(52) U.S. Cl. ..... 162/358.3; 162/272; 162/361; 162/358.4; 162/205

(58) Field of Classification Search ..... 162/358.3, 162/272, 361, 358.4, 205
See application file for complete search history.

(56) References Cited

U.S. PATENT DOCUMENTS 4,568,423 A * 2/1986 Laapotti ..... 162/358.3
4,747,195 A 5/1988 Snellman
5,645,691 A 7/1997 Zuefle et al.
5,997,695 A * 12/1999 Ilmarinen ..... 162/358.3

FOREIGN PATENT DOCUMENTS

| | | | |
|---|---|---|---|
| CA | 2154317 A1 | | 1/1996 |
| DE | 44 25 915 A1 | | 2/1996 |
| EP | 0 949 376 A3 | | 3/1999 |
| WO | WO 99/45195 | * | 9/1999 |
| WO | WO 02/079570 A1 | | 10/2002 |

OTHER PUBLICATIONS

Search Report Issue in FI 20010678.
International Search Report issued in PCT/FI02/00278.
Written Opinion issued in PCT/FI02/00278.
International Preliminary Examination Report issued in PCT/FI02/00278.

* cited by examiner

*Primary Examiner*—Mark Halpern
(74) *Attorney, Agent, or Firm*—Stiennon & Stiennon

(57) ABSTRACT

For profiling a fiber web (W) a shoe roll (10) defines a roll nip (4) with an opposite counter-roll (3). The shoe roll (10) has a static roll frame (5), a shoe element (2) located at the roll nip (4) and an endless belt (6) rotating about the shoe element (2) and the static roll frame (5). A lubricating cycle (71) is provided between the endless belt (6) and the shoe element (2) in the roll nip. The surface of the web (W) is profiled in the nip by loading the loading element (8). Before or after the shoe element (2), the shoe roll (10) has a longitudinally extending profiling strip (1) which can be pressurized to be able to perform thickness profiling of the surface of the fiber web (W). The static roll frame (5) and the shoe element (2) the endless belt (6) rotate about the profiling strip.

21 Claims, 1 Drawing Sheet

SHOE ROLL

CROSS REFERENCES TO RELATED APPLICATIONS

This application is a national stage application of International Application No. PCT/FI02/00278, filed Feb. 4, 2002, and claims priority on Finnish Application No. 20010678, Filed Apr. 2, 2001.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an arrangement for profiling a fibre web on a shoe roll.

In shoe calenders, the nip pressure is usually in the range from 2–15 Mpa and the nip pressure is controlled by means of the tilt of the shoe element combined with loading. A shoe calender has a relatively long shoe element in the machine direction, often of up to 270 mm or more, thus allowing good surface smoothness of the fibre web while preserving the bulk, because despite the relatively high loading pressure of the shoe element, the maximum pressure in the roll nip will remain relatively low.

However, especially in pre-calendering of the fibre web, surface thickness profiling is often required in addition to surface smoothness profiling of the fibre web. Current shoe calenders are not suitable for surface thickness profiling, because the maximum compression load achieved in the roll nip with these is relatively low despite the high loading pressure of the shoe element. If a shoe calender is used for pre-calendering a fibre web such as a cardboard web, one has nowadays to carry out thickness profiling of the fibre web surface with a separate hard profiling roll. A separate calender for thickness profiling increases the machine direction space requirement regarding the shoe calender alone, and also increases the purchasing and operating costs of the paper and cardboard making machine. If a hard roll for surface thickness profiling is brought into contact with the counter-roll of the shoe roll (thermo-roll), the machine direction space requirement will decrease, but the operating and purchasing costs of the installation are still higher than they would be, could a shoe calender alone be used for pre-calendering. In some cases, the fibre web feed may also cause problems.

The arrangement of the invention and the shoe roll used in it are intended to overcome the shortcomings in the prior art.

SUMMARY OF THE INVENTION

Thus the main purpose of the invention is to achieve a shoe roll that allows smoothness, glaze, humidity and thickness profiling of the fibre web surface to be performed.

The invention is based on the fundamental idea that, underneath an endless belt rotating about the shoe roll, a narrow continuous profiling strip is provided to extend substantially from one end to the other in the longitudinal direction of the shoe roll. The profiling strip is preferably located in the roll nip, in the immediate vicinity of the shoe of the shoe roll (also referred to as a shoe element below). Due to the narrow profiling strip, the area of the roll nip between the profiling strip and the counter roll will be small, and then the compression load required for surface thickness profiling in the roll nip (nip pressure) can be provided at a sufficiently high level even with relatively low loading pressures of the profiling strip.

In the arrangement of the invention for profiling a fibre web, the shoe roll has an opposite counter-roll and the shoe roll and the counter-roll are separated by the roll nip, whereby the shoe roll has a static roll frame, a shoe element at the roll nip and an endless belt rotating around the shoe element and the static roll frame, a lubricating cycle is provided between the endless belt and the shoe element, as the fibre web is passing through the roll nip, its surface is profiled by loading the shoe element with loading elements, the shoe roll also comprises a profiling strip extending substantially from one end to the other of the roll in the longitudinal direction, the profiling strip can be pressurised so as to be able to perform thickness profiling of the fibre web surface, and the endless belt rotates around the profiling strip in addition to the static roll frame of the shoe roll and the shoe element.

The profiling strip is preferably located in the roll nip, immediately after the shoe element, with the roll nip viewed from the input direction of the fibre web.

The shoe roll of the invention has a fibre web profiling strip which is narrow in the machine direction and which achieves the significant advantage over known calendaring and press installations that smoothness, glaze and thickness profiling of the fibre web and humidity and thickness profiling in shoe presses can now be performed with one single shoe calendar. Using the shoe element of the shoe calender, it is possible to achieve good surface smoothness of the fibre web while preserving the fibre web bulk. A profiling strip disposed in connection with the shoe of the shoe calender (shoe element), in turn, allows efficient thickness profiling of the fibre web.

Using one single shoe calender for thickness and smoothness profiling of the fibre web achieves notable savings in service, purchasing and operating costs compared to a situation, where thickness and smoothness profiling of the fibre web are performed by two separate calenders. At the same time, the machine direction space requirement is reduced, which is a benefit when a calendering line is installed on confined sites. Compared to the situation where calendering is performed with a shoe roll and a hard chilled roll mounted in connection with the same thermo-roll (counter-roll), benefits are gained in the form of reduced operating, service and purchasing costs. The fibre web feeding also becomes simpler when one single shoe calender is used for calendering instead of using a shoe roll and a hard profiling roll mounted in connection with the same thermo-roll.

The shoe roll of the invention, which is equipped with a profiling strip, can be used also in connection with presses for thickness profiling of a fibre web. Presses are used in paper and cardboard making machines for mechanical dewatering of the fibre web. Such presses have a press shoe fixed to a stationary frame, about which an endless belt rotates. Opposite the press shoe, a hard press roll is disposed. On one or usually both sides of the fibre web, a water-absorbing press fabric is provided to absorb water in the roll nip between the press shoe and its opposite press roll. Between the press shoe and the belt, a lubricating cycle is arranged in the roll nip in order to reduce the friction between these. Humidity and thickness profiling of the fibre web surface takes place between the press shoe and the press roll.

In such a press equipped with a shoe roll, the term shoe element implies the press shoe of the press. Accordingly, a roll frame implies the static press frame, to which the press shoe is attached.

In this application, the shoe element length and the roll nip length stand for the machine direction length of the shoe element and the roll nip, respectively. U.S. Pat. Nos. 5,645,691 and 4,741,905 disclose wet presses equipped with shoe elements, comprising various supplementary parts for enhancing dewatering action. However, these inventions do not allow the pre-calendering result of a fibre web, especially that of a cardboard web, to be improved as does the arrangement of the invention and the shoe roll used in this.

The invention is described more in detail below with reference to the accompanying drawing.

DESCRIPTION OF THE PREFERRED EMBODIMENTS

Figure 1:
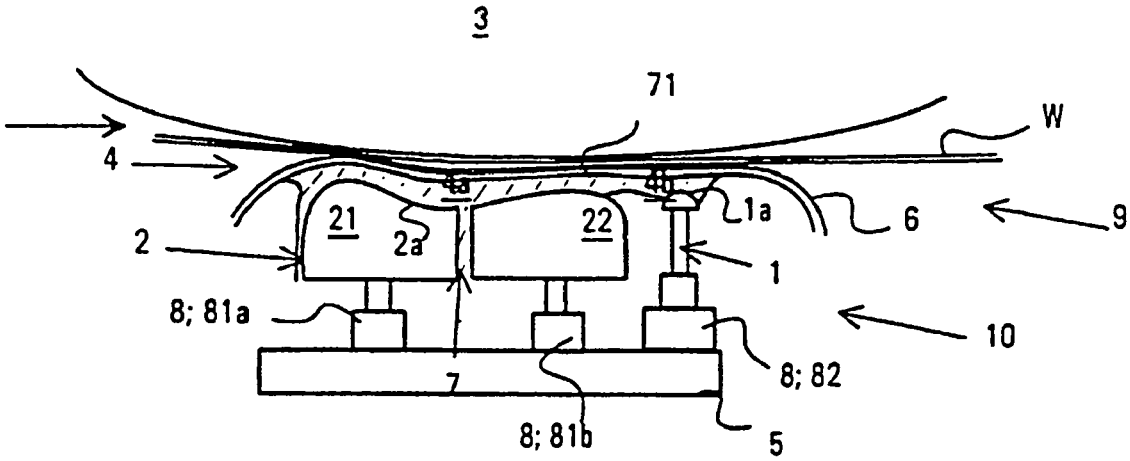
FIG. 1 shows a schematic cross-sectional view of a part of the shoe roll of the invention, viewed from the end of the pair of rolls between the shoe roll and its opposed counter-roll.

The shoe calender 9 shown in FIG. 1 has a shoe roll 10, having an opposite heated hard roll, i.e. thermo-roll 3. Regarding the shoe element of the shoe roll and its loading and lubricating systems, the shoe calender 9 has a conventional design per se, and hence the figure shows only part of the shoe roll in order to illustrate the inventive idea. The shoe roll 10 has a static frame 5, with only its upper part shown in the figure, a loading element 8 bearing against the static frame 5 with its lower surface, and a shoe element 2 on top of the loading element. The first part 4*a* of the roll nip 4 is located between the shoe element 2 and the counter-roll 3. Adjacent to the shoe element 2 of the shoe roll, there is a profiling strip 1, which in this case is located after the first part 4; 4*a* of the roll nip, with the roll nip 4 viewed in the input direction of the fibre web W. The input direction of the fibre web has been indicated in the figure with an arrow with a full head.

The second part 4*b* of the roll nip 4 is between the profiling strip 1 and the counter-roll 3. An endless belt 6 slides in the roll nip 4; 4*a*, 4*b* on the upper, i.e. slide surface 2*a* of the shoe element 2 and on the upper surface 1*a* of the profiling strip 1. This endless belt rotates about the static frame 5 of the shoe roll, the shoe element 2 and the profiling strip 1. A lubricating oil cycle 71 has been provided with a lubricating system 7 in the roll nip 4, between the slide surface 2; 2*a* of the shoe element and the upper surface 1*a* of the profiling strip and the endless belt.

The slide surface 2*a* of the shoe element forms a concave pocket when the roll nip 4; 4*a* is viewed from the direction of the counter-roll 3. By contrast, the upper surface 1*a* of the profiling strip has a concave shape when the roll nip 4; 4*b* is viewed from the direction of the counter-roll 3, so that the nip pressure between the thermo-roll and the profiling strip will rise sufficiently with a view to thickness profiling of the fibre web. The profiling strip 1 has a width parallel to the longitudinal axis of the shoe element, which is roughly the same as the width of the shoe element. Thus the profiling strip extends substantially from one end to the other of the shoe roll in its longitudinal direction.

The profiling strip 1 is substantially continuous and has a length in the machine direction, which is significantly smaller than the length of the shoe element. With the roll nip 4 viewed from the direction indicated by the arrow with a full head, i.e. in the input direction of the fibre web W, the roll nip 4 first comprises a conventional roll nip 4; 4*a* between the shoe element 2 the shoe roll and the thermo-roll 3, followed by a roll nip 4; 4*b* between the profiling strip 1 and the thermo-roll 3. Viewed from the direction of the counter-roll 3, the roll nip 4 first comprises a fibre web W and an endless belt 6 underneath this. Underneath the endless belt rotating on the axial frame 5 of the shoe roll 10, in turn, the shoe element 2 and the profiling strip 1 are disposed.

Different nip pressures are usually exerted on the first part 4*a* and the second part 4*b* of the roll nip 4. The nip pressure is generated in the first part 4*a* of the roll nip 4 with rows of press cylinders 81; 81*a*; 81*b* provided underneath the shoe element 2 and with which the shoe element 2 is pressed (loaded) against the counter-roll 3. The rows of press cylinders 81*a* and 81*b* bear against the frame 5 at their lower part. The rows of press cylinders 81*a* and 81*b* may generate the same or different compression loads on the front part 21 and the rear part 22 of the shoe element. The nip pressure of the second part 4; 4*b* of the roll nip, again, is generated with a press cylinder 8; 82 provided underneath the profiling strip, the press cylinder bearing on the frame 5 at its lower part. Although the profiling strip is loaded, i.e. pressed against the counter-roll by the pressure cylinder 8; 82 usually at lower pressure than is the shoe element by the press cylinder 8; 81, the nip pressure formed between the profiling strip and the counter-roll will become appreciably higher than the nip pressure formed between the shoe element and the counter-roll, owing to the smaller area of the upper surface 1*a* of the profiling strip in the roll nip.

As the roll nip is closed by loading the shoe element of the shoe roll and/or profiling strip with loading elements 8; 81, 82, the fibre web W, such as a heated cardboard web, will be pressed in the two-part roll nip 4; 4*a*, 4*b* between the heated counter-roll (thermo-roll) 3 and the shoe roll 10 and the profiling strip 1, while its surface is being calendered. As a specific part of the fibre web W enters the first part 4*a* of the roll nip between the shoe element and the counter-roll, the fibre web surface is smoothness profiled while the bulk level is preserved at a high level. Smoothness profiling occurs owing to the relatively low nip pressure prevailing in the roll nip 4*a*. The nip pressure will remain low, even if the total loading pressure generated with the loading elements 8; 81 on the shoe element, i.e. the linear pressure, were relatively high, because the shoe element area is relatively large (the shoe element may have a machine direction length of up to 270 mm or more). After this, the same fibre web W part reaches the second part 4*b* of the roll nip 4 between the thermo-roll and the profiling strip. The compression load in the roll nip 4; 4*b* now depends mainly on two factors; the area of the upper surface of the profiling strip and the loading pressure of the profiling strip. Since the profiling strip 1 should have a width roughly equal to that of the shoe element 2, the machine direction length of the upper surface 1*a* of the profiling strip should be dimensioned for a shoe calender of a given width such that a given loading pressure of the profiling strip allows a sufficiently high compression load (nip pressure) to be achieved between the profiling strip and the counter-roll in the roll nip 4; 4*b*. The loading pressure of the profiling strip can be kept relatively low (5–15 Mpa), while the nip pressure achieved in the second part 4; 4*b* of the roll nip still rises to a high level. This is due to the fact that the profiling strip 1 is considerably shorter in the machine direction than the shoe element 2, and in addition, it may have a convexly shaped upper surface, so that the area of the upper surface 1*a* of the profiling strip 1 is but small in the roll nip. Owing to the high nip pressures, the surface of the fibre web is profiled as desired in the thickness direction of the fibre web.

The example above exemplifies only one embodiment of the shoe calender 9 of the invention, and the inventive idea can be carried out in several other ways as well, without departing from the scope of the inventive idea defined in the claims. Usually the profiling strip is located in the immediate vicinity of the shoe element in the roll nip. However, it is also conceivable to dispose the profiling strip elsewhere underneath the endless belt rotating about the shoe roll. In one option, the profiling strip is disposed on the opposite side of the shoe roll viewed from the roll nip, i.e. at a distance of 180 degrees from the roll nip in the cross-sectional circle of the shoe roll.

In some cases, the profiling strip 1 may be disposed before the shoe element 2 when the roll nip is viewed from the input direction of the fibre web W.

In the example above, the shoe element of the shoe calender was pressurized by means of two rows of hydraulic cylinders. Both in shoe calenders and in shoe presses, however, the shoe element can be pressurized with e.g. one row of hydraulic cylinders or with any other loading elements known in connection with shoe calenders and shoe presses.

The invention claimed is:

1. A paper or cardboard making machine defining a machine direction, comprising:

a shoe element defining a longitudinal axis extending in a crossmachine direction, the shoe element having a machine direction length and a longitudinal direction length along the longitudinal axis, the shoe element mounted to a static frame by a plurality of first loading elements;

a profiling strip considerably narrower than the shoe element in the machine direction, and roughly equal in longitudinal direction length, and mounted to the static frame by a plurality of second loading elements, the profiling strip located in the immediate vicinity of the shoe element spaced downstream in the machine direction from the shoe element;

an endless belt rotatably mounted about the shoe element, the profiling strip and the static frame;

an opposed counter-roll forming a first nip with the roll shoe and a second nip with the profiling strip so that the endless belt passes through the first nip and the second nip; and a lubricating system arranged to providing a lubricating cycle between the endless belt, and the shoe element and the profiling strip.

2. The paper or cardboard making machine of claim 1 wherein the first loading elements and the second loading elements are of the same type.

3. The paper or cardboard making machine of claim 1 wherein the profiling strip is substantially continuous.

4. The paper or cardboard making machine of claim 1 wherein the profiling strip has a convexly shaped upper surface.

5. The paper or cardboard making machine of claim 1 wherein the opposed counter-roll is a thermo-roll.

6. The paper or cardboard making machine of claim 1 wherein the second nip is arranged so the second nip has a higher nip pressure than the first nip.

7. The paper or cardboard making machine of claim 6 wherein the first nip pressure is arranged to be between 2 to 15 Mpa.

8. The paper or cardboard making machine of claim 1 wherein the opposed counter-roll is a thermo-roll.

9. The paper or cardboard making machine of claim 1 wherein the shoe element has a machine direction length of at least about 270 mm.

10. A paper or cardboard making machine defining a machine direction, comprising:

a shoe element defining a longitudinal axis extending in a crossmachine direction, the shoe element having a machine direction length and a longitudinal direction length along the longitudinal axis, the shoe element mounted to a static frame by a plurality of first loading elements;

a profiling strip considerably narrower than the shoe element in the machine direction, and roughly equal in longitudinal direction length, and mounted to the static frame by a plurality of second loading elements, the profiling strip located in the immediate vicinity of the shoe element spaced downstream in the machine direction from the shoe element;

an endless belt rotatably mounted about the shoe element, the profiling strip, and the static frame;

an opposed counter-roll forming a first nip with the roll shoe and a second nip with the profiling strip so that the endless belt passes through the first nip and the second nip;

a lubricating system arranged to provide a lubricating cycle between the endless belt, and the shoe element and the profiling strip; and wherein the first nip is loaded to a first nip pressure and the second nip is loaded to a pressure greater than the first nip.

11. The paper or cardboard making machine of claim 10 wherein the profiling strip has a convexly shaped upper surface.

12. The paper or cardboard making machine of claim 10 wherein the first loading elements and the second loading elements are of the same type.

13. The paper or cardboard making machine of claim 10 wherein the first nip pressure is between 2 to 15 Mpa.

14. The paper or cardboard making machine of claim 10 wherein the profiling strip is substantially continuous.

15. The paper or cardboard making machine of claim 10 wherein the first nip and the second nip are arranged for smoothness and thickness profiling of the fibre web respectively.

16. The paper or cardboard making machine of claim 10 wherein the second nip is arranged so the second nip has a higher nip pressure than the first nip.

17. The paper or cardboard making machine of claim 10 wherein the shoe element has a machine direction length of at least about 270 mm.

18. A paper or cardboard making machine defining a machine direction, comprising:

a shoe element defining a longitudinal axis extending in a crossmachine direction, the shoe element having a machine direction length and a longitudinal direction length along the longitudinal axis, the shoe element mounted to a static frame by a plurality of upstream press cylinders, and a plurality of downstream press cylinders spaced downstream from the upstream press cylinders in the machine direction;

a profiling strip considerably narrower than the shoe element in the machine direction, and roughly equal in longitudinal direction length, and mounted to the static frame by a further plurality of press cylinders, the profiling strip located in the immediate vicinity of the shoe element and spaced downstream in the machine direction from the shoe element;

an endless belt rotatably mounted about the shoe element, the profiling strip and the static frame;

an opposed counter-roll forming a first nip with the roll shoe and a second nip with the profiling strip so that the endless belt passes through the first nip and the second nip; and a lubricating system arranged to providing a lubricating cycle between the endless belt, and the shoe element and the profiling strip.

19. The paper or cardboard making machine of claim 18 wherein the upstream press cylinders, the downstream press cylinders and the further plurality of press cylinders are of the same type.

20. The paper or cardboard making machine of claim 18 wherein the profiling strip has a convexly shaped upper surface.

21. The paper or cardboard making machine of claim 18 wherein the shoe element has a machine direction length of at least about 270 mm.

* * * * *